US009331390B2

(12) United States Patent
Petropoulos

(10) Patent No.: US 9,331,390 B2
(45) Date of Patent: May 3, 2016

(54) ANTENNA ASSEMBLIES

(71) Applicant: Laird Technologies, Inc., Earth City, MO (US)

(72) Inventor: Athanasios Petropoulos, Hudson, NH (US)

(73) Assignee: LAIRD TECHNOLOGIES, INC., Earth City, MO (US)

( * ) Notice: Subject to any disclaimer, the term of this patent is extended or adjusted under 35 U.S.C. 154(b) by 12 days.

(21) Appl. No.: 14/227,710

(22) Filed: Mar. 27, 2014

(65) Prior Publication Data

US 2015/0280324 A1 Oct. 1, 2015

Related U.S. Application Data

(60) Provisional application No. 61/970,651, filed on Mar. 26, 2014.

(51) Int. Cl.

| | |
|---|---|
| ***H01Q 21/20*** | (2006.01) |
| ***H01Q 9/28*** | (2006.01) |
| ***H01Q 1/22*** | (2006.01) |
| ***H01Q 1/38*** | (2006.01) |

(52) U.S. Cl.

CPC ..... *H01Q 9/285* (2013.01); *H01Q 1/2291* (2013.01); *H01Q 1/38* (2013.01)

(58) Field of Classification Search

CPC ..... H01Q 9/285; H01Q 21/30; H05K 1/141; H05K 1/14; H05K 7/1425

USPC ..... 343/796, 795, 797, 799, 810; 361/784, 361/788, 803, 796

See application file for complete search history.

(56) References Cited

U.S. PATENT DOCUMENTS

| | | | | |
|---|---|---|---|---|
| 4,071,846 | A * | 1/1978 | Oltman, Jr. | H01Q 21/062 343/700 MS |
| 6,008,763 | A | 12/1999 | Nystrom et al. | |
| 6,359,596 | B1 * | 3/2002 | Claiborne | H01Q 1/38 343/795 |
| 7,180,461 | B2 | 2/2007 | Petropoulos et al. | |
| 2007/0052589 | A1 | 3/2007 | Liu | |
| 2009/0009399 | A1 * | 1/2009 | Gaucher | H01Q 21/0006 343/700 MS |
| 2012/0044118 | A1 * | 2/2012 | Lee | H01Q 1/246 343/795 |
| 2012/0119954 | A1 | 5/2012 | Chen | |

FOREIGN PATENT DOCUMENTS

JP 2013175895 9/2013

OTHER PUBLICATIONS

International Search Report and Written Opinion dated Nov. 27, 2014 for PCT International Application No. PCT/US2014/052550 filed Aug. 25, 2014 which claims priority to the same parent application as the instant application; 7 pages.

Vertically Polarized Omni Antennas OC24527; Dual-Band Vertically Polarized Omni Antenna; Copyright 2011; 1 page.

OC24527 Specifications; date unknown; 1 page.

* cited by examiner

*Primary Examiner* — Hoang V Nguyen

*Assistant Examiner* — Collin Dawkins

(74) *Attorney, Agent, or Firm* — Harness, Dickey & Pierce, P.L.C.

(57) ABSTRACT

According to various aspects, exemplary embodiments are disclosed of antenna assemblies. In an exemplary embodiment, an antenna assembly generally includes a feed network and a ground plane. Radiating dipoles or dipole radiating elements are along or on opposite sides of the feed network and the ground plane. The radiating dipoles or dipole radiating elements may be operable simultaneously and co-locate radio frequency currents for a first frequency band and a second frequency band.

20 Claims, 17 Drawing Sheets

ANTENNA ASSEMBLIES

CROSS-REFERENCE TO RELATED APPLICATION

This application claims the benefit of and priority to U.S. Provisional Application No. 61/970,651 filed Mar. 26, 2014. The entire disclosure of the above application is incorporated herein by reference.

FIELD

The present disclosure generally relates to antenna assemblies.

BACKGROUND

This section provides background information related to the present disclosure which is not necessarily prior art.

Wireless local area networks (WLAN) may operate in multiple frequency ranges, such as, for example, a range between about 2.4 GHz and about 2.5 GHz, and a range between about 5.15 GHz and about 5.9 GHz. These WLAN networks may be used indoors or outdoors. Omnidirectional antennas may be configured to radiate approximately equally in all directions, and may be configured to radiate at multiple operating frequencies.

SUMMARY

This section provides a general summary of the disclosure, and is not a comprehensive disclosure of its full scope or all of its features.

According to various aspects, exemplary embodiments are disclosed of antenna assemblies. In an exemplary embodiment, an antenna assembly generally includes a feed network and a ground plane. Radiating dipoles or dipole radiating elements are along or on opposite sides of the feed network and the ground plane. The radiating dipoles or dipole radiating elements may be operable simultaneously and co-locate radio frequency currents for a first frequency band and a second frequency band.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 1:
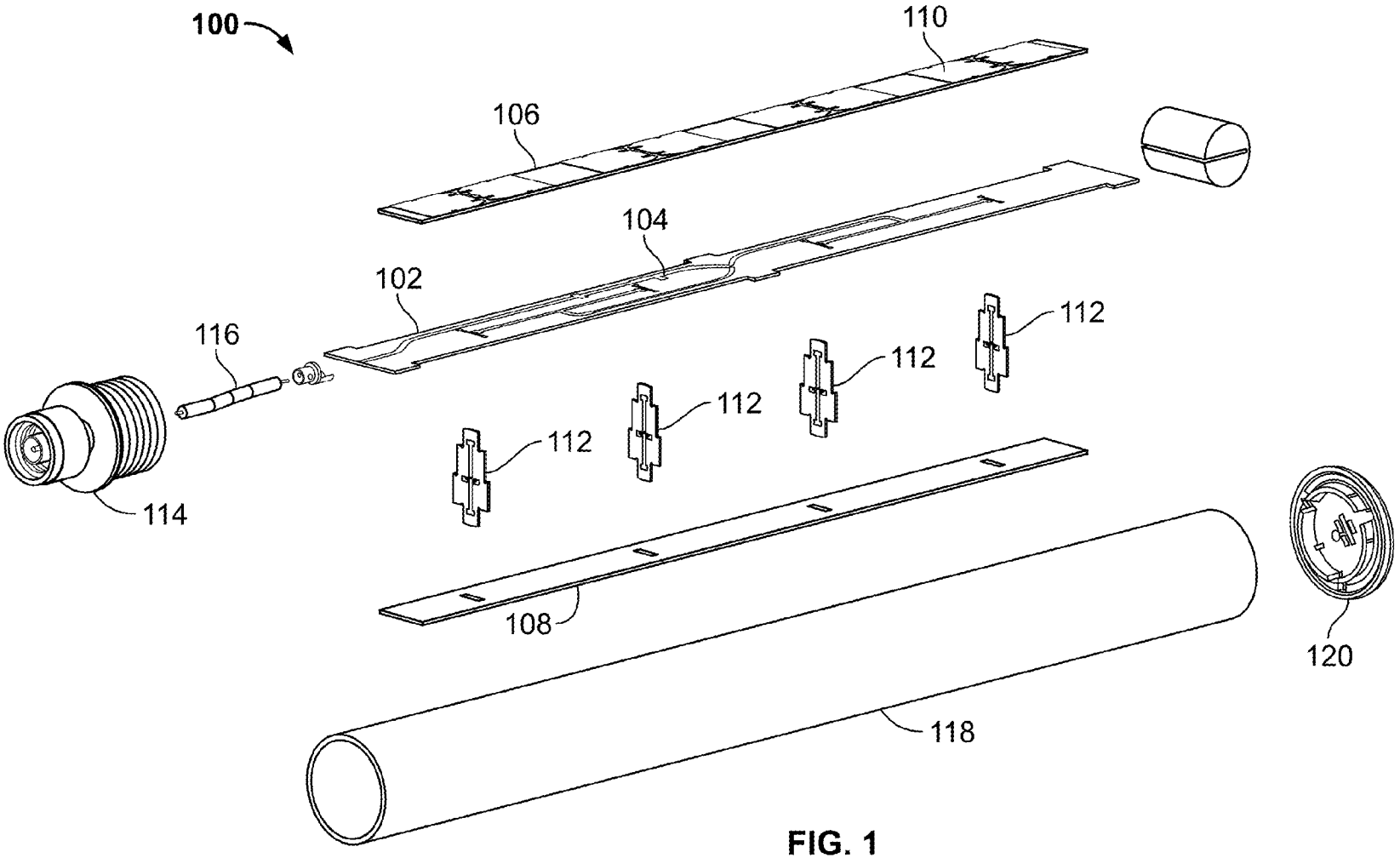
FIG. 1 is an exploded perspective view of an antenna assembly according to an exemplary embodiment.
Figure 2:
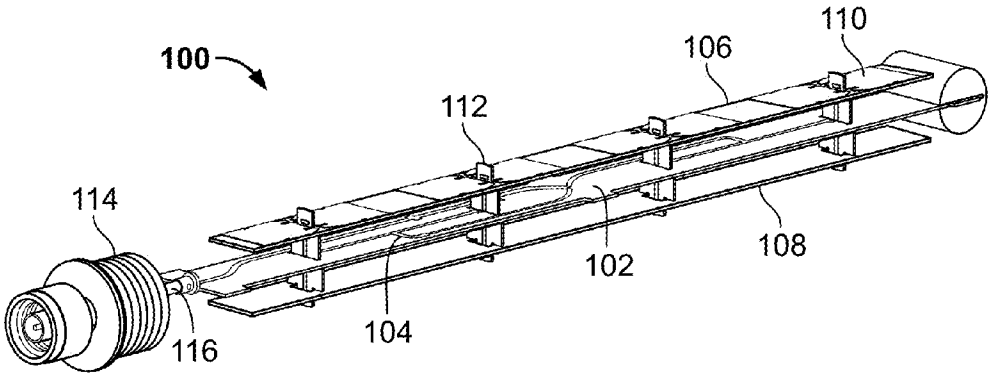
FIG. 2 is a perspective view of the antenna components shown in FIG. 1 after being assembled and without showing the radome.
Figure 5A:
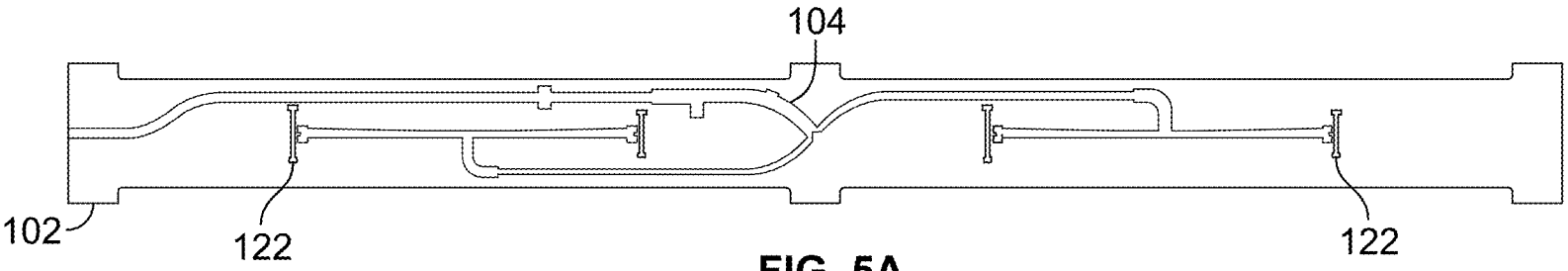
Figure 5B:
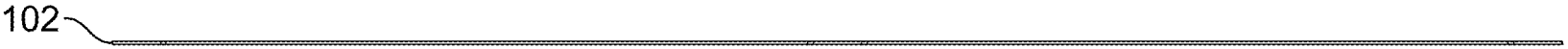
Figure 5C:
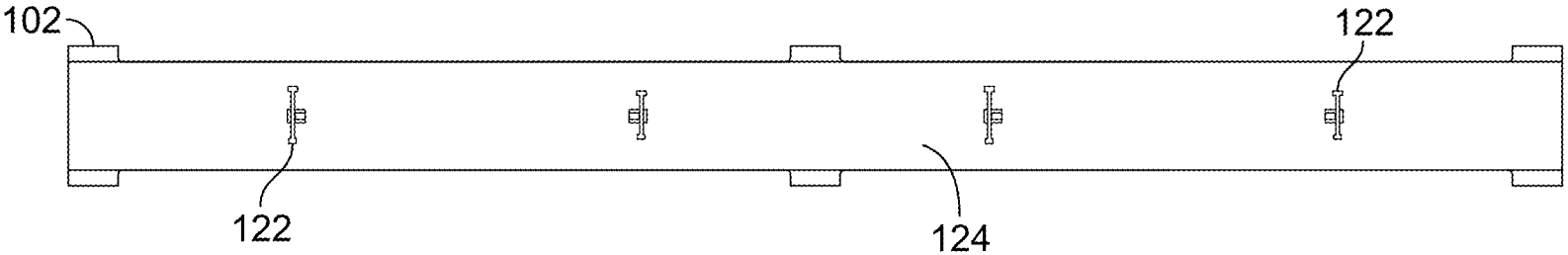
Figure 6A:
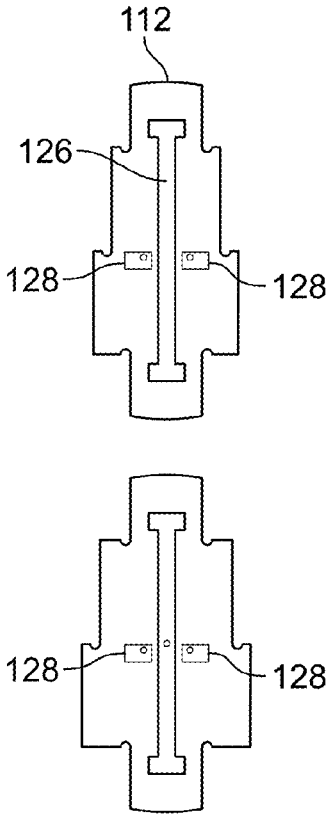
Figure 6B:
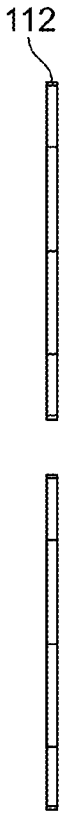
Figure 6C:
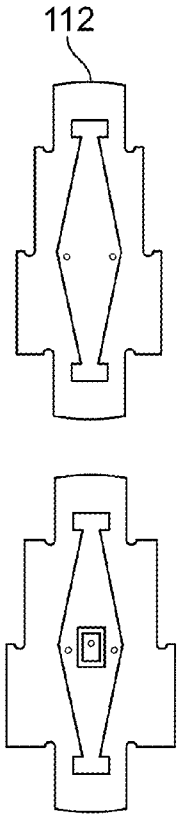
Figure 7A:
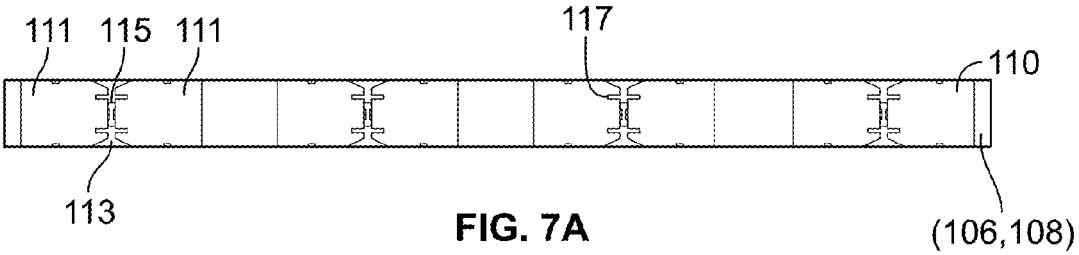
Figure 7B:
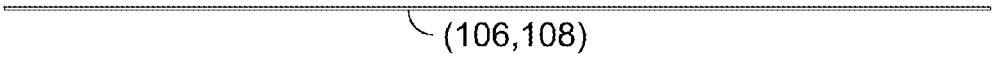
Figure 8:
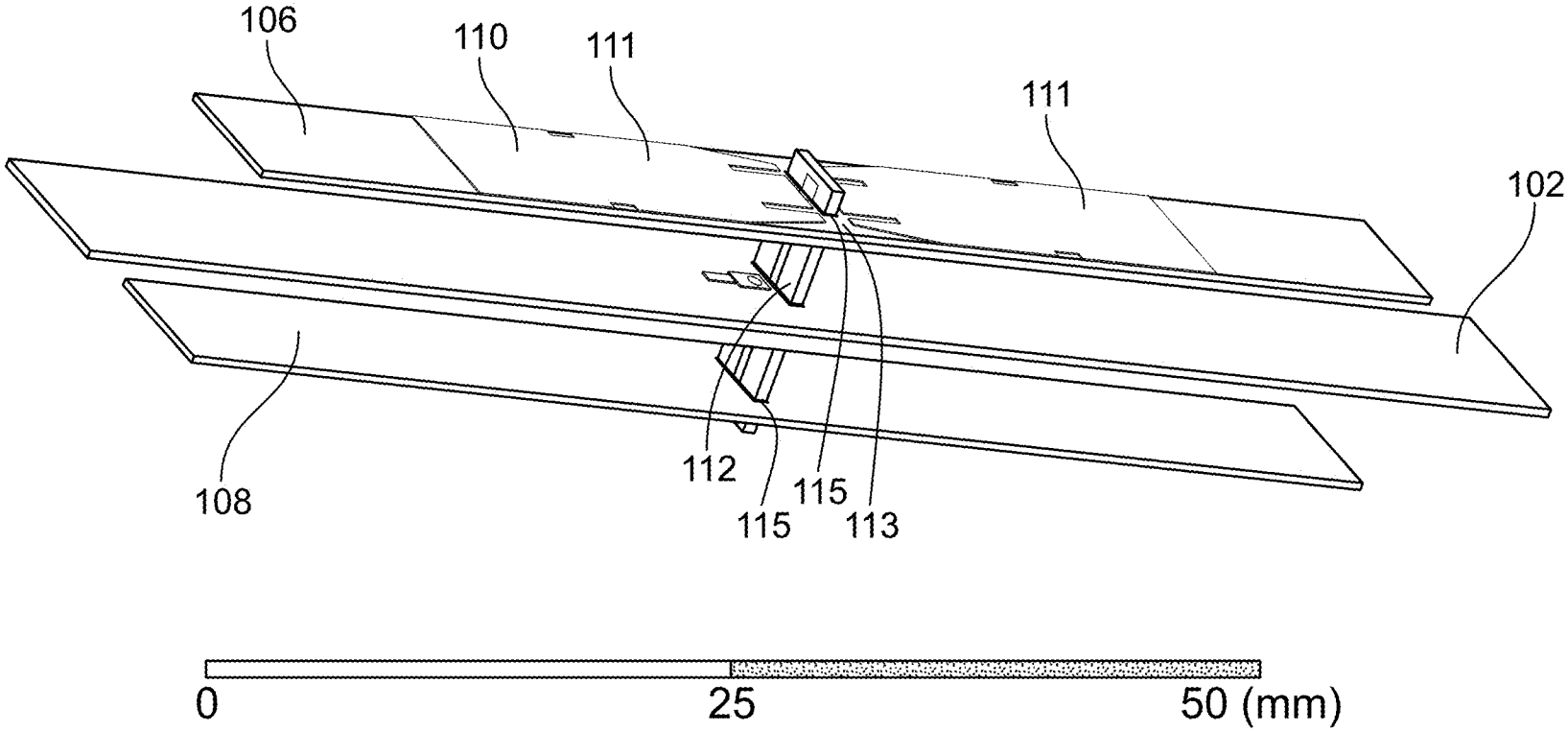
Figure 9:
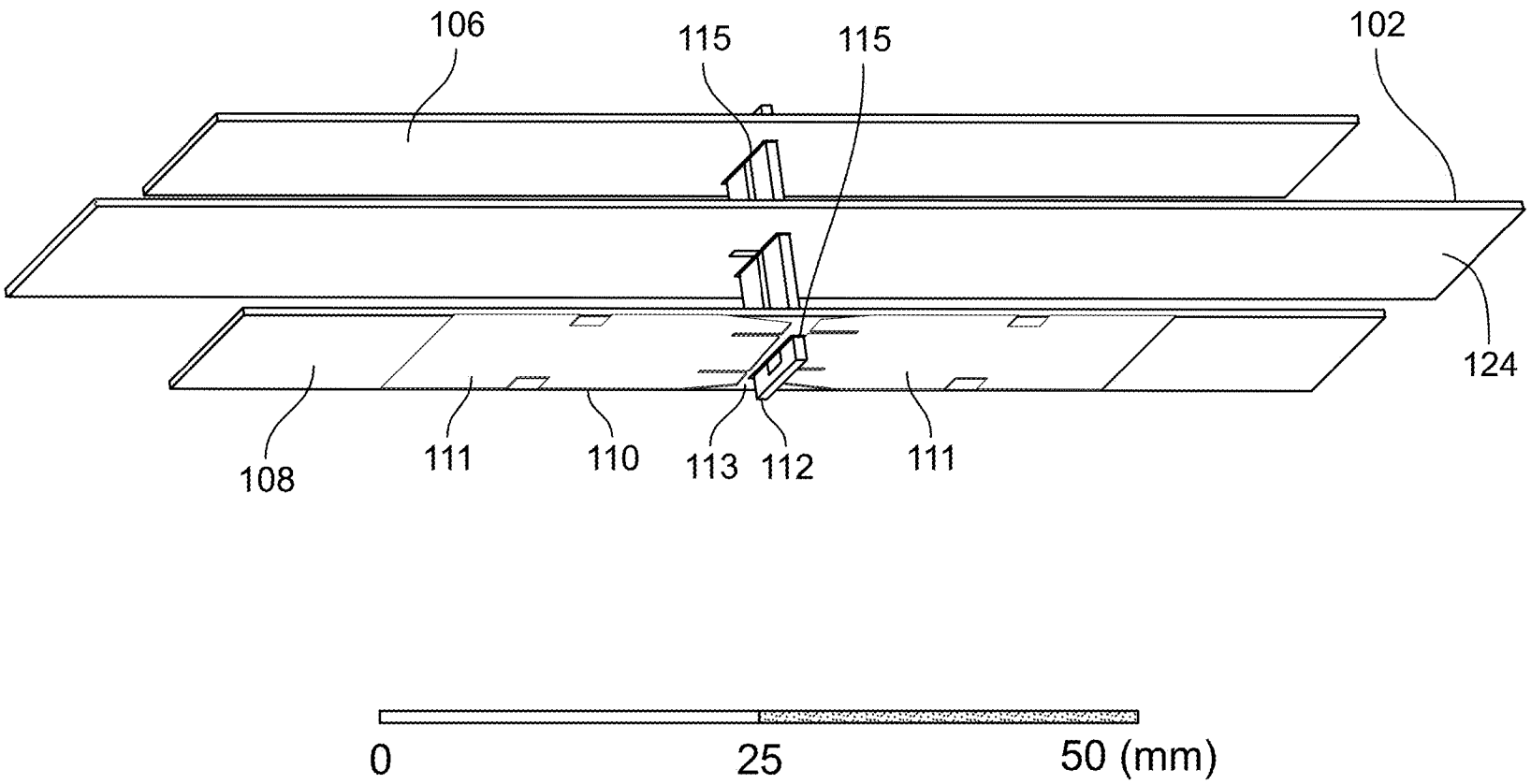
Figure 10:
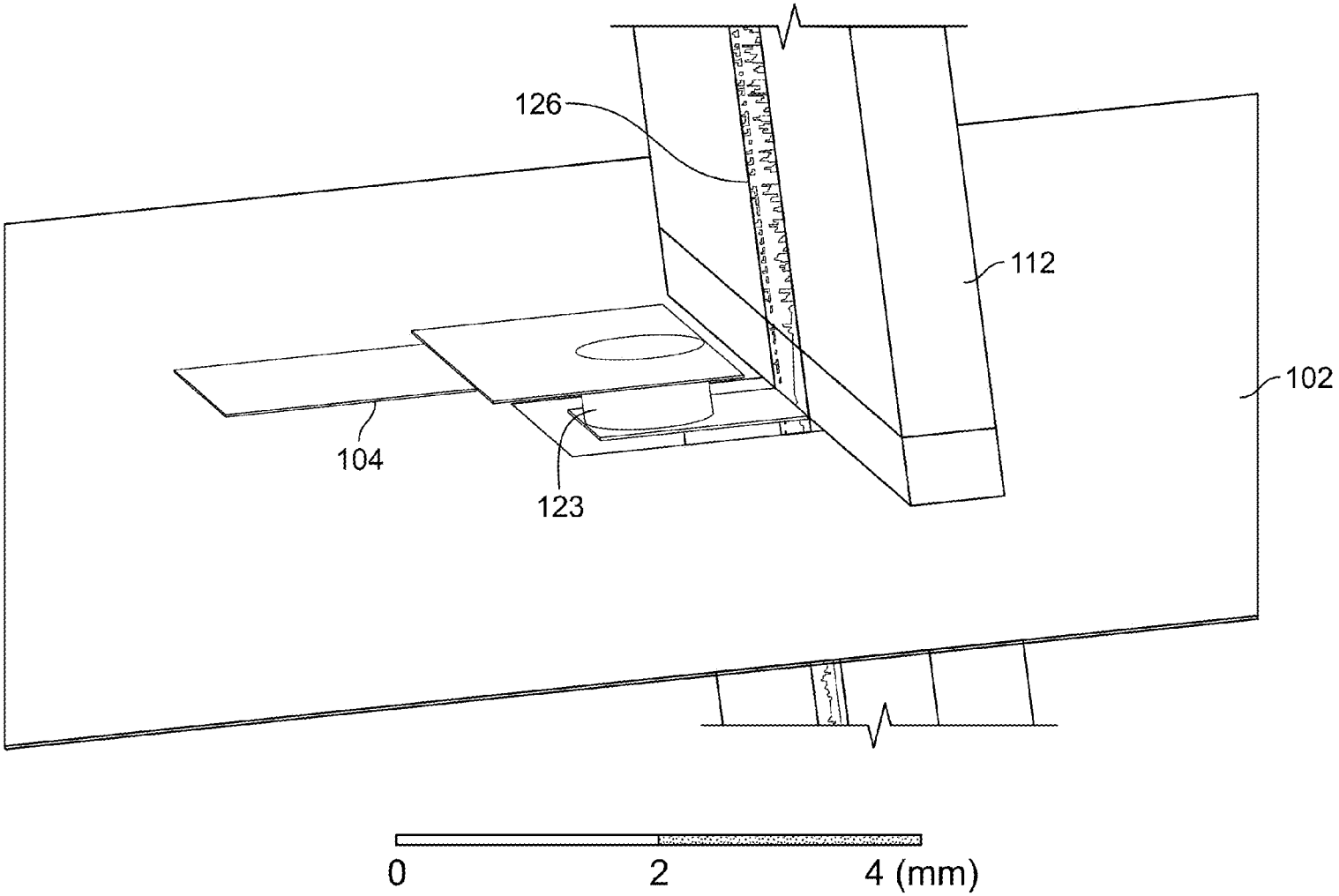
Figure 11:
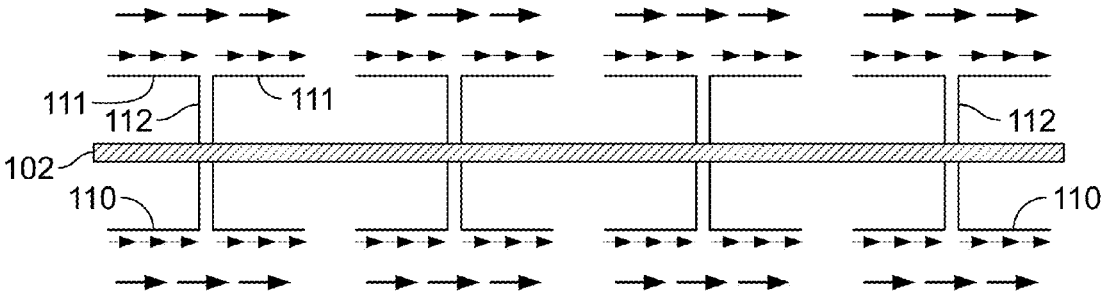
Figure 12:
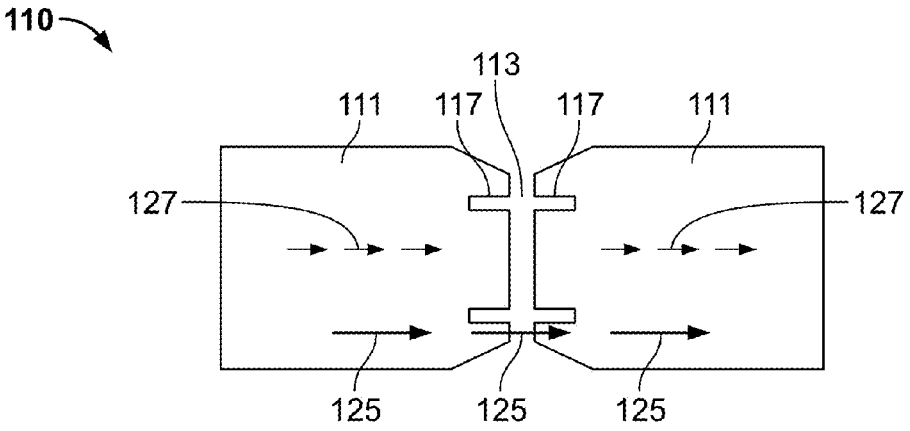
Figure 13:
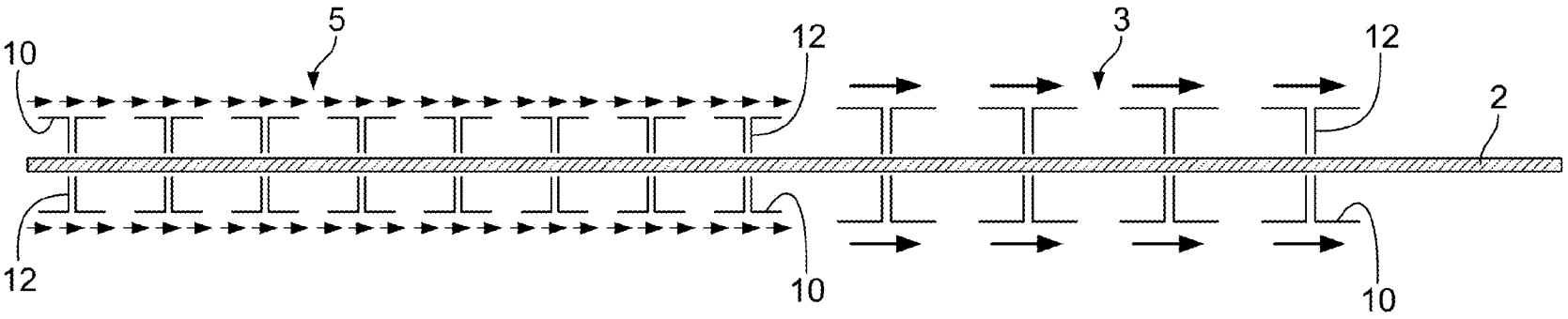
FIG. 13 (Prior Art)
Figure 14:
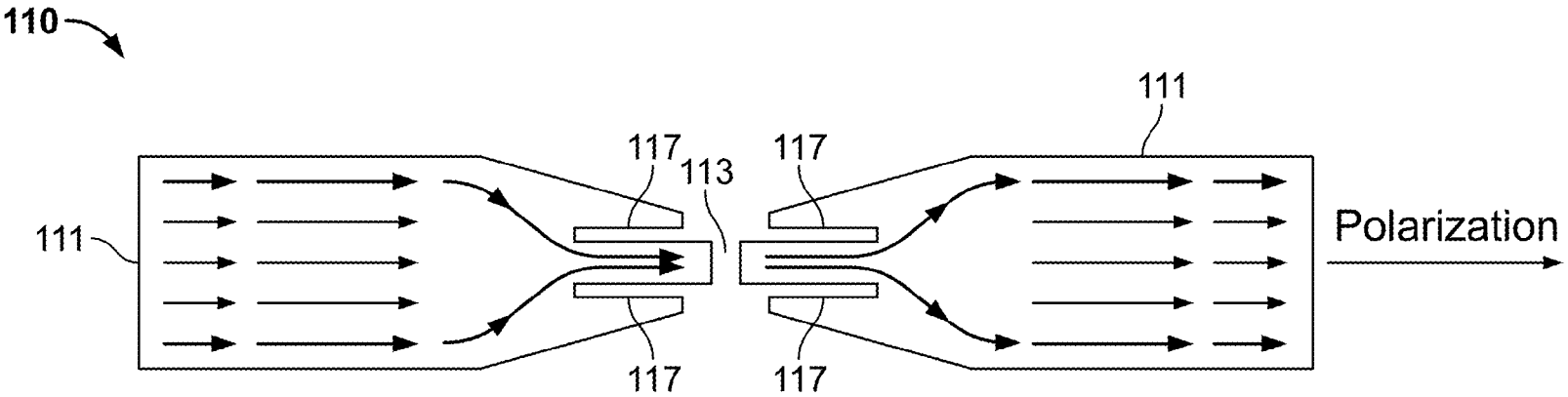
Figure 15:
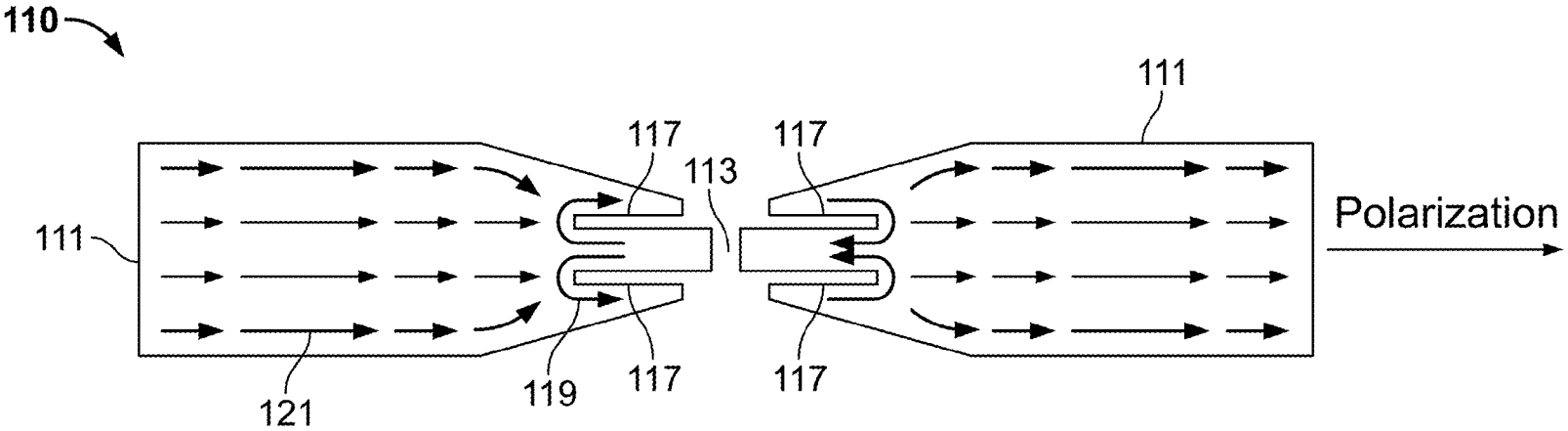
Figure 16:
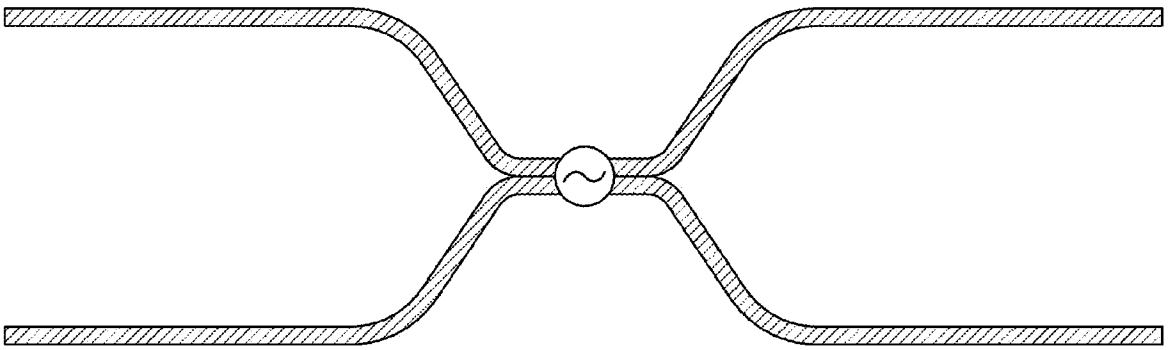
Figure 17:
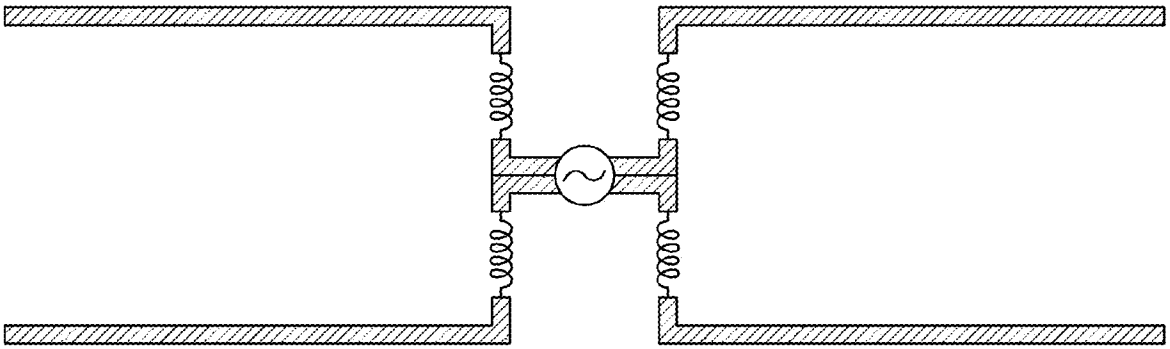
Figure 18:
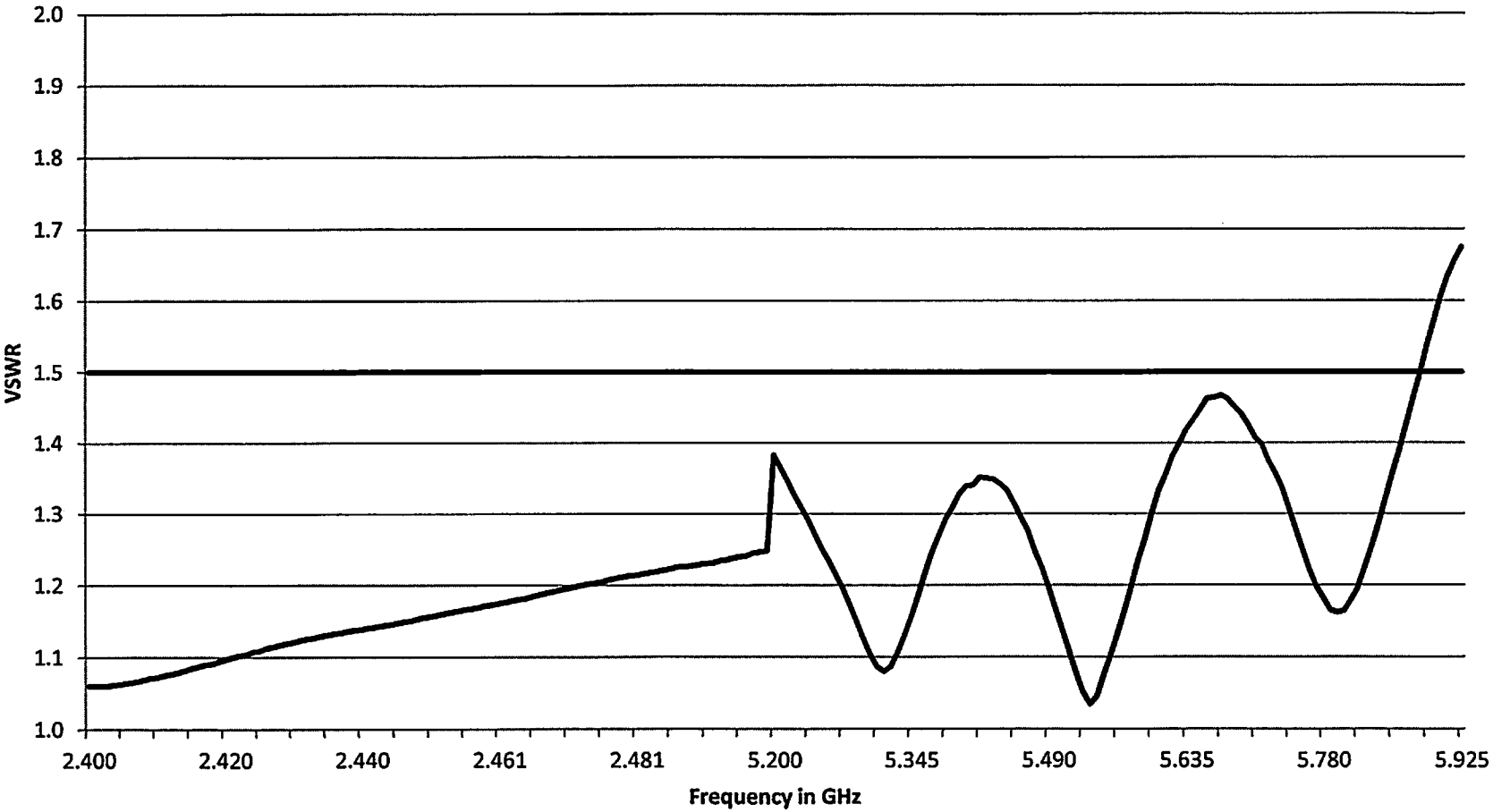
Figure 19:
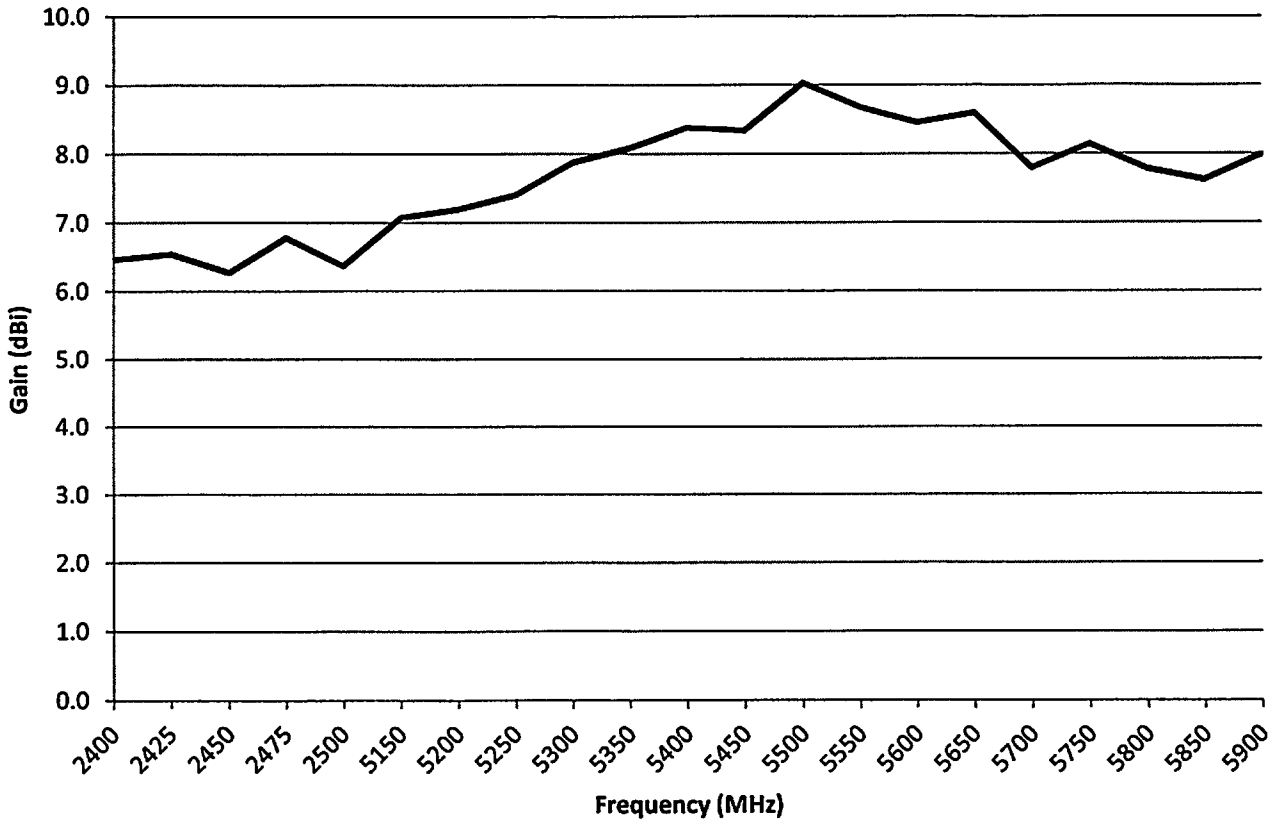
Figure 20:
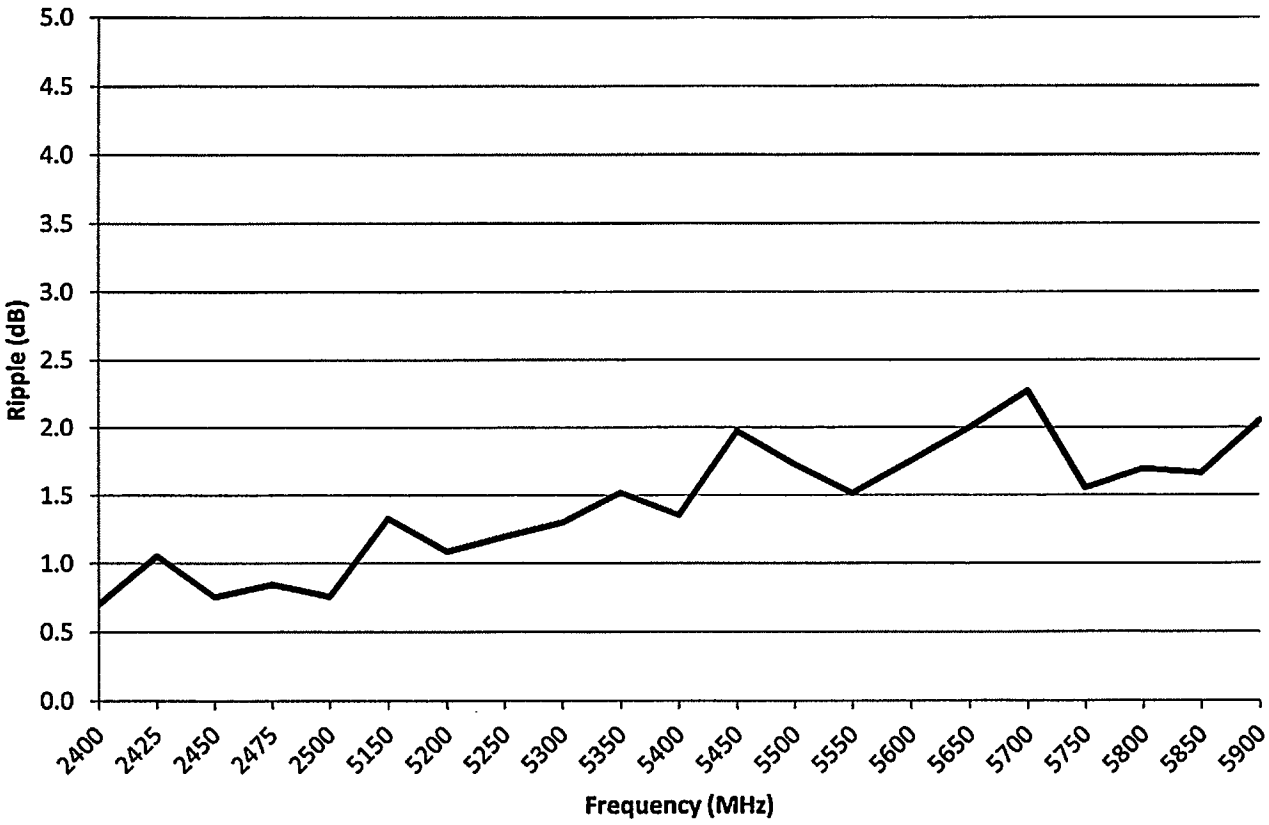
Figure 21:
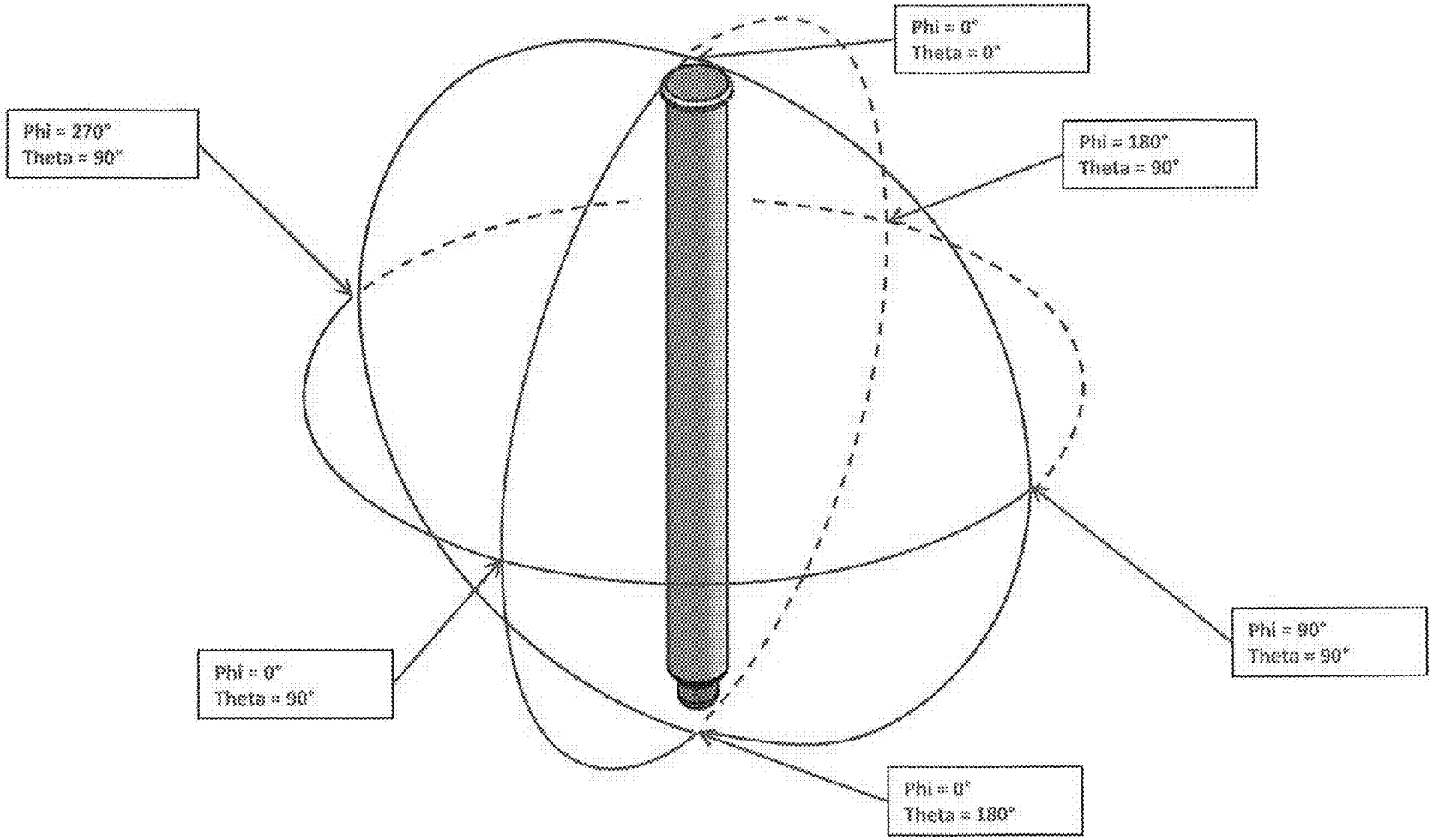
Figure 22:
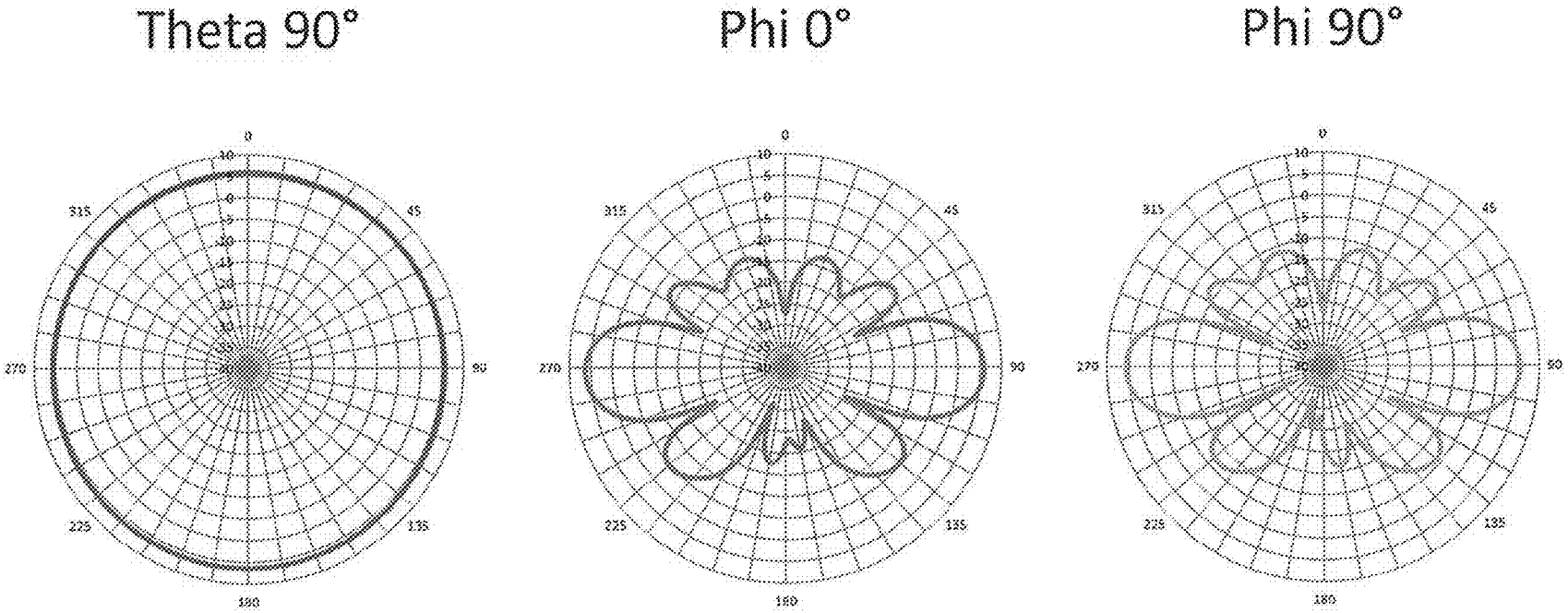
Figure 23:
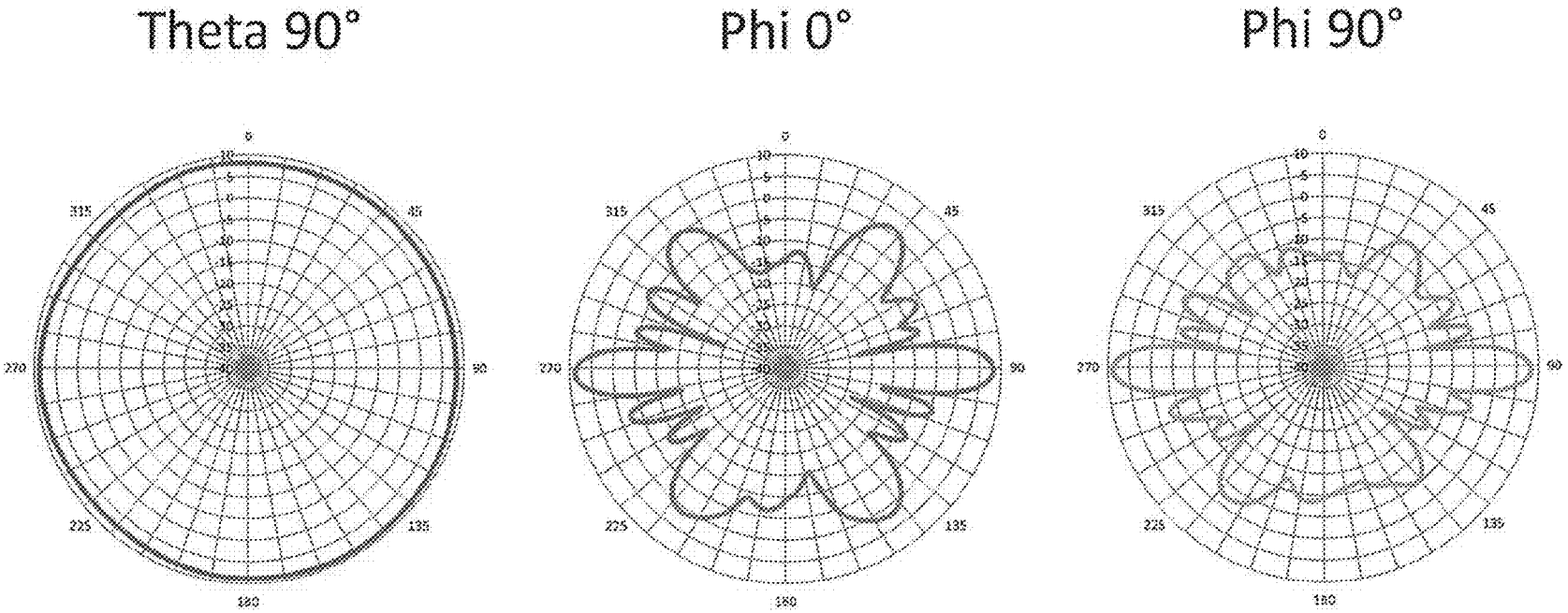

FIGS. 5A, 5B, and 5C are respective top, side, and bottom views of the network board shown in FIG. 1, and illustrating microstrip lines along a top of the network board and an electrically-conductive laminate (ground plane) along a bottom of the network board according to this exemplary embodiment;

FIGS. 6A, 6B, and 6C are respective front, side, and back views of two of the interconnect boards shown in FIG. 1, and illustrating microstrip lines and vias according to this exemplary embodiment;

FIGS. 7A and 7B are plan and side views of one of the two radiating boards shown in FIGS. 1 and 2, and illustrating an array of radiating dipoles spaced apart along the board according to this exemplary embodiment;

FIG. 8 is an upper perspective view of a portion of the antenna assembly shown in FIG. 2, and illustrating an interconnect board, a network board, two dipole or radiating boards, and a dipole on the top of the upper board according to this exemplary embodiment;

FIG. 9 is a lower perspective view of the portion of the antenna assembly shown in FIG. 8, and further illustrating a dipole on the bottom of the lower board and an electrically-conductive laminate (ground plane) along a bottom of the network board according to this exemplary embodiment;

FIG. 10 is an upper perspective view showing a portion of the interconnect board and network board of the antenna assembly shown in FIG. 2, and illustrating an exemplary way of connecting the microstrip lines of the network board and interconnect board according to this exemplary embodiment;

FIG. 11 is a side view of a portion of the antenna assembly shown in FIG. 2, and illustrating how a four dipole-like 2.4 GHz array may be co-located with an eight dipole-like 5 GHz array in this exemplary embodiment, where the arrows indicate radiating currents for the 2.4 GHz band and 5 GHz band that are co-located on the radiating elements;

FIG. 12 is a top view of a dipole or radiating element shown in FIG. 11, where the arrows indicate radiating currents for the 2.4 GHz band and 5 GHz band that are co-located on the radiating element, and also illustrating how the radiating element is operable as a typical single dipole element for the 2.4 GHz band and operable as two separate dipole-like elements separated by a distance for the 5 GHz band;

FIG. 13 is a side view of a conventional antenna that includes twelve different radiating elements on each side, where an array of four dipole radiating elements is operable for the low band (2.4 GHz band) and another array of eight dipole radiating elements is operable for the high band (5 GHz band), where the arrows indicate radiating currents at 2.4 GHz and 5 GHz separately located on the respective four and eight dipole arrays;

FIG. 14 shows an example current flow in a dipole of the antenna assembly shown in FIG. 2 when the dipole is operated at a frequency of about 2.5 GHz;

FIG. 15 shows an example current flow in a dipole of the antenna assembly shown in FIG. 2 when the dipole is operated at a frequency of about 5.5 GHz;

FIG. 16 is an example circuit model for the dipole shown in FIG. 14 when the dipole is operated at a frequency of about 2.5 GHz;

FIG. 17 is an example circuit model for the dipole shown in FIG. 15 when the dipole is operated at a frequency of about 5.5 GHz;

FIG. 18 is an exemplary line graph of the voltage standing wave ratio (VSWR) versus frequency in gigahertz (GHz) measured for a physical prototype of the antenna assembly including the radome shown in FIGS. 1 through 4;

FIG. 19 is an exemplary line graph of the peak gain in decibels relative to isotropic (dBi) versus frequency in megahertz (MHz) measured for the physical prototype of the antenna assembly including the radome shown in FIGS. 1 through 4;

FIG. 20 is an exemplary line graph of the ripple in decibels (dB) versus frequency (MHz) measured for the physical prototype of the antenna assembly including the radome shown in FIGS. 1 through 4;

FIG. 21 shows the pattern orientation and planes relative to a prototype antenna during radiation pattern testing;

FIG. 22 illustrates radiation patterns (Theta 90°, Phi 0°, and Phi 90° plane) measured for the physical prototype of the antenna assembly including the radome shown in FIGS. 1 through 4 at a frequency of about 2450 MHz; and FIG. 23 illustrates radiation patterns (Theta 90°, Phi 0°, and Phi 90° plane) measured for the physical prototype of the antenna assembly including the radome shown in FIGS. 1 through 4 at a frequency of about 5500 MHz.

DETAILED DESCRIPTION

Example embodiments will now be described more fully with reference to the accompanying drawings.

The inventor has developed and discloses herein exemplary embodiments of antennas assemblies that may be high gain, multi-band, compact, and omnidirectional. The antenna assemblies may be used for indoor/outdoor wireless local area network (WLAN) applications. The antenna assemblies may operate in multiple bands including a first or low band (e.g., 2.4 GHz band, etc.) and a second or high band (e.g., 5 GHz band, etc.). Accordingly, the antenna assemblies may thus operate within multiple frequency ranges or band (e.g., multiple Wi-Fi bands, etc.) including a first or low frequency range or band (e.g., from about 2.4 GHz to about 2.5 GHz) and a second or high frequency range or band (e.g., from about 5.15 GHz to about 5.9 GHz). The antenna assemblies may have a high gain of greater than about seven decibels relative to isotropic (dBi) while radiating omnidirectionally in the horizon at frequencies from about 2.4 GHz to about 2.5 GHz and from about 5.15 GHz to about 5.9 GHz. The antenna assemblies may have a high gain of between about eight decibels and about ten decibels (dB) for Wi-Fi band frequencies. The antenna assemblies may have a compact size (e.g., length less than about 15 inches or 381 millimeters, diameter of about 1.5. inches or 38.1 millimeters, etc.). The antenna assemblies may have a low omnidirectional radiation ripple (e.g., less than two decibels, etc.) in the horizon for all operating frequencies. The antenna assemblies may have a low voltage standing wave ratio (VSWR) of less than about 1.5:1 for some or most frequencies.

In exemplary embodiments, an antenna assembly includes an array of radiating dipoles (e.g., radiating elements printed on printed circuit boards, etc.) along and spaced apart from opposite sides of a network board. The network board may be a printed circuit board having a first or upper side that includes a feed network (e.g., a microstrip feedline network, transmission line network, electrically-conductive traces, etc.) and a second or lower side that includes a ground plane (e.g., electrically-conductive laminate, etc.).

A first set or plurality of radiating elements (e.g., an array of four dipoles, etc.) is spaced apart along (e.g., equally spaced apart, etc.) a first radiating board, which, in turn, is spaced apart from the first side of the network board. A second set or plurality of radiating elements (e.g., an array of four dipoles, etc.) is spaced apart along (e.g., equally spaced apart, etc.) a second radiating board, which, in turn, is spaced apart from the second side of the network board. The first and second set of radiating elements may be positioned such that each radiating element of the first radiating board is aligned with corresponding one of the radiating elements of the second radiating board. The first and second sets of radiating elements cooperatively define the array of radiating dipoles (e.g., 2×4 array of dipoles, etc.). The radiating elements may be configured to radiate radio frequency (RF) energy omnidirectionally.

RF energy may enter the antenna assembly through a connector (e.g., N-connector, etc.) connected to a transmission or communication line or link (e.g., a coaxial cable, etc.). Interconnect boards are used to move RF energy from the network board to the radiating dipoles of the first and second radiating boards. Each interconnect board may be used to electrically connect a corresponding pair of the radiating elements of the first and second radiating boards. The antenna components may be enclosed within a radome (e.g., cylindrical radome having a length of 15 inches (381 millimeters) or less, etc.).

In some exemplary embodiments, the antenna assembly includes only four interconnecting boards and only four dipole type radiating elements on each of the first and second radiating boards. The radiating elements co-locate RF currents for both the 2.4 GHz band and the 5 GHz band. The radiating elements are operable simultaneously for both the 2.4 GHz band and the 5 GHz band. For the 2.4 GHz band, each radiating element is operable as a typical single dipole element, such that the radiating elements are collectively operable as or similar to an array of four radiating dipoles. But for the 5 GHz band, each radiating element is operable as two separate dipole-like elements separated by a slot or distance. The radiating elements are thus collectively operable as or similar to an array of eight dipoles for the 5 GHz band. Accordingly, this exemplary embodiment includes or co-locates a four dipole-like 2.4 GHz array with an eight dipole-like 5 GHz array where both arrays are defined by or use the same radiating elements, i.e., the first set of four radiating elements of the first radiating board and the second set of four radiating elements of the second radiating board.

FIG. 1 illustrates an exemplary embodiment of a high gain, multi-band omnidirectional antenna assembly 100 embodying one or more aspects of the present disclosure. As shown, the antenna assembly 100 includes a network board 102 having a first or upper side and a second or lower side. The first side of the network board 102 includes a feed network comprised of one or more microstrip lines 104 (broadly, one or more transmission or communication lines or links). The second side includes a ground plane 124 (e.g., electrically-conductive laminate, etc.) as shown in FIG. 5.

As shown in FIG. 2, a first radiating board 106 is approximately parallel to the network board 102 and spaced apart from the first side of the network board 102. A second radiating board 108 is located approximately parallel to the network board 102 and spaced apart from the second side of the network board 102.

Each radiating board 106, 108 has at least one dipole or dipole radiating element 110 (broadly, radiating element). In this example, the first radiating board 106 includes a first set or array of only four dipole radiating elements 110 spaced apart along (e.g., equally spaced apart, etc.) the upper side of the first radiating board 106. Also in this example, the second radiating board 108 includes a second set or array of only four dipole radiating elements 110 spaced apart along (e.g., equally spaced apart, etc.) the lower side of the second radiating board 108.

The antenna assembly 100 also includes one or more interconnect or interconnecting boards 112. The interconnect boards 112 are operable to provide an electrical connection between the feed network of the network board 102 and the radiating elements 110 of the radiating boards 106, 108.

In this illustrated example embodiment, the antenna assembly 100 includes only four interconnecting boards 112 and only four dipole radiating elements 110 on each of the radiating boards 106, 108. Alternative embodiments may include different configurations of interconnecting boards and/or dipole radiating elements, such as more or less than four, other sizes, other shapes, non-linear arrays, antenna elements or radiators that are not in an array, etc.

The network board 102 may be coupled to a connector 114. The connector 114 may be configured to connect to a transmission or communication line or link (e.g., coaxial cable, etc.) for sending and/or receiving signals between the antenna assembly 100 and an antenna signal source. RF energy may enter and leave the antenna assembly 100 through the connector 114. In this example, the connector 114 is illustrated as an N-connector for connection to a coaxial cable, but other suitable connectors may also be used.

The connector 114 may be coupled to the network board 102 using a semi-rigid cable 116. Other suitable coupling elements may also be used to couple the network board 102 to the connector 114.

Figure 4:
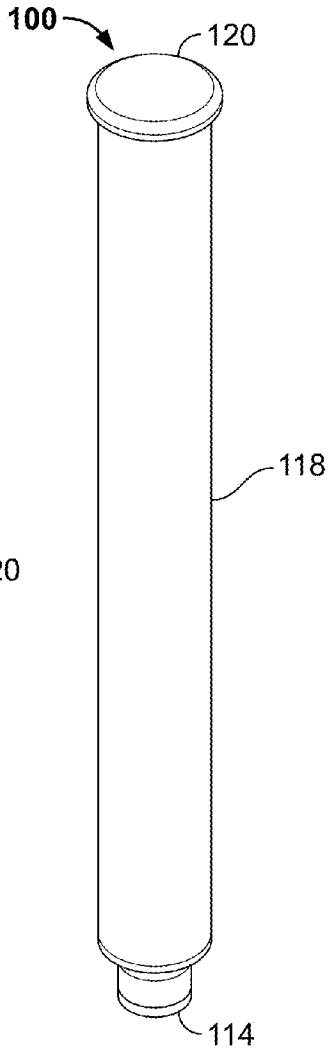
FIG. 4 is another perspective view of the antenna assembly shown in FIG. 3.
Figure 3:
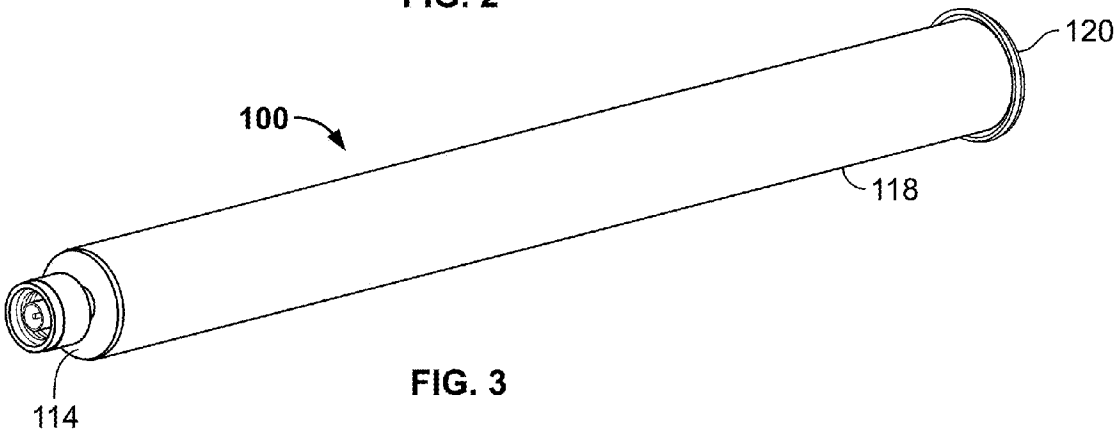
FIG. 3 is a perspective view of the antenna assembly shown in FIG. 1 after being fully assembled and also showing the radome.

The antenna assembly 100 includes a radome 118. The radome 118 may have a cylindrical shape and a length of 15 inches (381 millimeters) or less. The radome 118 may include a radome cap 120 coupled to a first end of the radome 118. The second end of the radome 118 may be coupled to the connector 114. As shown by FIGS. 2, 3, and 4, the radome 118 may be used to house, enclose, and protect the antenna components from the environment. The network board 102, radiating boards 106, 108, and interconnect boards 112 may be positioned within and enclosed in an internal space or cavity defined by the radome 118, radome cap 120, and connector 114.

FIGS. 5A, 5B, and 5C respectively show the top, side, and bottom of the network board 102. As shown in FIG. 5A, the first or top side of the network board 102 includes microstrip lines 104. The microstrip lines 104 may be used to transfer radio frequency (RF) energy between the connector 114 and interconnect boards 112. In turn, the interconnect boards 112 may be used to transfer RF energy between network board 102 and the dipole radiating elements 110 on the radiating boards 106, 108.

The microstrip lines 104 may cover a portion of the first side of the network board 102 and may comprise any suitable material for providing an electrical connection, such as, for example, a printed circuit board (PCB), conductive metal, electrically-conductive traces, etc. The microstrip lines 104 may provide an electrical connection path between the connector 114 and each interconnect board 112, which may create as many microstrip line paths as interconnect boards 112. The network board 102 may include one or more slots 122 for receiving the interconnect boards 112. The microstrip lines 104 may provide a path from adjacent each slot 122 to the connector 114. Although one example microstrip line configuration is illustrated in FIG. 5A, other configurations, other feeds, or transmission line types may also be used.

As shown by FIG. 5C, the second or bottom side of the network board 102 includes a ground plane 124. The ground plane 124 may cover a portion, substantially all, or the entirety of the second side of the network board 102. The ground plane 124 may comprise any suitable material for creating a grounding plane for the antenna assembly 100, such as, for example, an electrically-conductive laminate, an electrically-conductive metal, etc.

FIGS. 6A, 6B, and 6C respectively show the front, side, and back of two of the interconnect boards. As shown in FIG. 6A, the interconnect boards 112 include microstrip lines 126 (broadly, more transmission or communication lines or links). The interconnect board microstrip lines 126 may be used to move RF energy from the network board 102 to the radiating boards 106, 108. Each microstrip line 126 of the interconnect boards 112 may be electrically coupled to a corresponding portion of the microstrip lines 126 of the network board 102, to thereby provide a path from the interconnect board microstrip lines 126 to the connector 114. The microstrip line 126 of each interconnect board 112 may be electrically coupled to the radiating boards 106, 108 at each end of the interconnect board microstrip line 126. The interconnect board microstrip lines 126 are electrically coupled to corresponding ones of the dipole radiating elements 110 of the radiating boards 106, 108 at each end portion of the interconnect board microstrip line 126. The interconnect board microstrip line 126 may be approximately symmetrical to provide equal (or substantially equal) amounts of RF energy to each radiating board 106, 108. Although FIGS. 6A-C illustrate example configurations of the interconnect board microstrip lines 126, other configurations, other feeds, or transmission line types may also be used.

The microstrip lines 126 may cover a portion of one or both sides of the corresponding interconnect board 112. The microstrip lines 126 of the interconnect boards 112 may comprise any suitable material for providing an electrical connection, such as, for example, a PCB, conductive metal, electrically-conductive trace, etc.

As shown in FIGS. 6A and 6C, the interconnect boards 112 include vias 128. In this example, the vias 128 transition the signal from the microstrip lines (network level) to the ground level. The ground level may be exactly in the middle between radiating elements 110. A signal at the ground level may be divided symmetrically and reach the radiating elements 110 at the two sides of the ground plane 124 at or at about the same time. At the ground level, the signal may be moved from the vias connection to the interconnect board microstrip line 126 (at which point the signal may then split up and down). This short specific line at the ground level may also be referred to as a coplanar waveguide line, which transmission line has the "hot line" and the ground line at the same level.

In exemplary embodiments, the feed from the network board 102 to the interconnected boards 112 may be constructed or configured in a way that is perfectly symmetric, such that the feed point is exactly at the center of the interconnecting vertical microstrip line 126 of the interconnect boards 112. This symmetric feed results in same phase currents at the two dipole elements 110 above and below the network board 102. The same current phase in the radiating (dipole) elements 110 ensures low ripple in the azimuth plane radiation in these exemplary embodiments.

As shown in FIG. 7A, each radiating board 106, 108 includes an array of four dipole radiating elements 110 spaced apart along (e.g., equally spaced apart, etc.) along a side of the board 106, 108. The dipole radiating elements 110 cover a portion of one side of the radiating boards 106, 108. The dipole radiating elements 110 may comprise any suitable material for radiating RF energy, such as, for example, PCB traces, electrically-conductive metal, etc. The radiating boards 106, 108 include slots 115 for receiving corresponding end portions of the interconnect boards 112. A slot or thru-hole 115 is located adjacent to each dipole radiating element 110 at the middle of each radiating dipole between the first and second spaced-apart portions or legs 111 of the dipole radiating element 110, etc.

The first and second spaced-apart portions or legs 111 of each dipole 110 are spaced apart by a slot or gap 113. For the dipole 110 shown in FIG. 8, the dipole legs or portions 111 are on opposite sides of the upper end portion of the interconnect board 112, which is received through the slot 115 in the board 106. For the dipole 110 shown in FIG. 9, the dipole legs or portions 111 are on opposite sides of the lower end portion of the interconnect board 112, which is received through the slot 115 in the board 108. The electrically-conductive laminate 124 (broadly, ground plane) is along the bottom of the network board 102. The electrically-conductive laminate 124 may act as a reflector for each dipole 110 and may be located approximately an equal distance from each dipole 110. The dipole radiating elements 110 may radiate omnidirectionally in the Z-Y plane during operation of the antenna assembly 100. The 0 to 50 millimeter (mm) scale shown at the bottom of FIGS. 8 and 9 is for purpose of illustration only, as other embodiments may include larger or smaller antenna components.

FIG. 10 shows an exemplary way of connecting the microstrip lines of the network board 102 and interconnect boards 112 according to this exemplary embodiment. As shown, the network board 104 includes via 123. The feeding structure from the network board's microstrip lines 104 to the interconnect board's microstrip lines 126 may ensure or provide symmetrical feeding of each dipole 110 from the network's microstrip lines 104.

FIG. 11 is a side view of a portion of the antenna assembly shown in FIG. 2, and illustrating how a four dipole-like 2.4 GHz array may be co-located with an eight dipole-like 5 GHz array in this exemplary embodiment. FIG. 12 is a top view of one of the dipoles or radiating elements 110 shown in FIG. 11. In FIGS. 11 and 12, the arrows indicate radiating currents for the 2.4 GHz band and 5 GHz band that are co-located on the radiating elements 110. In FIG. 12, a single set of three arrows 125 extends across the entire radiating element 110, which indicates that the radiating element 110 is operable as a typical single dipole element for the 2.4 GHz band. For the 5 GHz band, however, the radiating element 110 is operable as two separate dipole-like elements separated by a distance as indicated by the two separate sets 127 of three arrows. One set of three arrows is on the left dipole portion or leg 111, while the other set of three arrows is on the right dipole portion or leg 111. In FIGS. 11 and 12, only the radiating currents are indicated because the radiating currents determine the radiation performance. The slot currents are not shown in FIGS. 11 and 12 for the 5 GHz band, but they are shown in FIG. 15 discussed below.

With continued reference to FIGS. 11 and 12, the antenna assembly includes only four interconnecting boards 112 and only four dipoles or radiating elements 110 on each radiating board. RF currents for both the 2.4 GHz band and the 5 GHz band are co-located on the radiating elements 110. Each radiating element 110 is operable simultaneously for both the 2.4 GHz band and the 5 GHz band. For the 2.4 GHz band, each radiating element 110 is operable as a typical single dipole element. But for the 5 GHz band, each radiating element 110 is operable as two separate dipole-like elements or legs 111 separated by the slot or distance 113. The network of the antenna assembly 100 may be simplified and take up much less space as compared to the network required for the conventional antenna shown in FIG. 13. Thus, the length of the radome 118 (e.g., 15 inches or 381 millimeters, etc.) can be reduced considerably as compared to the radome length (e.g., 27½ inches to 31½ inches or 700 to 800 millimeters, etc.) required for the conventional antenna shown in FIG. 13.

For the exemplary embodiment shown in FIG. 11, the antenna assembly includes only four interconnecting boards 112 and only four dipoles or radiating elements 110 on each radiating board. This is significantly less than the conventional antenna shown in FIG. 13, which requires twelve interconnecting boards 12 and twelve different radiating elements 10 on each side. This conventional antenna includes an array 3 of four dipole radiating elements for the low band (2.4 GHz band) and another array 5 of eight dipole radiating elements for the high band (5 GHz band). The arrays 3, 5 are spaced apart from each other and do not use or rely upon the same radiating elements 10. In FIG. 13, the arrows indicate radiating currents at 2.4 GHz and 5 GHz, which are not co-located as in FIGS. 11 and 12. Instead, FIG. 13 shows the radiating currents at 2.4 GHz and 5 GHz separated or isolated from each other as the low band radiating currents are located on or confined to the array 3 of four dipoles (on the right hand side of FIG. 13), whereas the high band radiating currents are located on or confined to the array 5 of eight dipoles (on the left hand side of FIG. 13).

With its twelve interconnect boards 12 and twelve radiating elements 10 on each side, the length of the conventional antenna is very large especially when configured to have omnidirectional patterns in the azimuth plane. For example, the conventional antenna may have a length of 27½ inches to 31½ inches (700 to 800 millimeters). The network board 2 is also very complex for this conventional antenna. For example, a special circuit or diplexer is required to combine the 2.4 GHz signals with the 5 GHz signals. The network board 2 takes up a lot of space because there are twelve total signals coming to the network board 2 that have to be combined. The network board 2 thus has to be relatively long, such that the antenna length is very large for the conventional antenna of FIG. 13 as compared to the antenna assembly of FIGS. 11 and 12.

FIG. 14 shows an example current flow (as indicated by arrows) in a dipole radiating element 110 of the antenna assembly 100 shown in FIG. 2 when the dipole 110 is operated at a frequency of about 2.5 GHz. The currents in this frequency band may be typical of a ½ lambda dipole. The dipole radiating element 110 includes first and second portions or legs 111, which are spaced apart in the center by the slot or gap 113. The currents may flow in the same direction (e.g., parallel to or toward the direction of polarization) along each portion 111 of the dipole radiating element 110. Although one example dipole configuration is illustrated in FIG. 14, other suitable dipole configurations may be used.

FIG. 15 shows the current flow (as indicated by arrows) in the dipole radiating element 110 of the antenna assembly 100 shown in FIG. 2 when the dipole is operated at a frequency of about 5.5 GHz. The dipole radiating element 110 includes four dipole slots 117 near the center of the dipole radiating element 110, with two dipole slots 117 along each portion 111 of the dipole 110. Each dipole slot 117 is oriented substantially parallel to the polarization direction. Although one example dipole slot configuration is illustrated in FIG. 15, other suitable slot configurations may be used. The currents in the 5 GHz frequency band may resemble a second mode of radiation of the dipole 110 of about one wavelength long. At the 5 GHz band, there may be two types of currents present or flowing in the dipole 110, which are slot currents 119 and same direction currents 121. The slot currents 119 flow around the dipole slots 117 in the dipole 110. The same direction currents 121 flow in the same direction (e.g., parallel to or toward the direction of polarization) along each portion 111 of the dipole 110. The slot currents 119 present at a frequency of about 5.5 GHz may not contribute significantly to radiation because their contributions may be cancelled in the far-field zone. But the same direction currents 121 may constructively contribute to provide the same polarization fields in the far-field zone. Without the slot currents 119, the impedance of the radiating dipoles at the high band may be very far away from a reasonable value of, for example, 50 ohms.

FIG. 16 is an example circuit model for the dipole radiating element 110 illustrated in FIG. 14 when the dipole 110 is operated at a frequency of about 2.5 GHz. The model may represent a typical ½ wavelength dipole at 2.5 GHz.

FIG. 17 is an example circuit model for the dipole radiating element 110 illustrated in FIG. 15 when the dipole 110 is operated at a frequency of about 5.5 GHz. Each dipole slot 117 may be modeled as an inductor 131 that raises the current at the base of the dipole 110 to match its impedance to the microstrip line impedance of the interconnect board 112. The currents responsible for radiation may be similar to currents that appear in a half wave dipole, which take about one-half wavelength on each dipole leg (e.g., see the set of three arrows on each dipole leg 111 in FIGS. 11 and 12, etc.). The overall current distribution at 5 GHz on one dipole leg is about ⅝ wavelengths long, and includes the one-half wavelength radiating currents and the additional slot currents. The additional slot currents do not contribute substantially to radiation. But the extended current path provided by the slot currents raises the current level substantially to bring impedance at the feed point of each dipole leg close to 50 ohms.

Using the same dipole radiating elements 110 for multiple frequency bands allows less dipole radiating elements 110 to be used in the antenna assembly 100. The size of the network may also be reduced to allow for a smaller antenna. The distribution of currents on the dipole radiating elements 110 may allow the array to have high gain (e.g., greater than seven dBi, etc.) and low radiation ripple (e.g., less than two decibels, etc.) without large grating lobes in the 5 GHz band in the elevation plane.

FIGS. 18 through 23 provide analysis results measured for a physical prototype of the antenna assembly 100 including the radome 118 shown in FIGS. 1 through 4. These analysis results are provided only for purposes of illustration and not for purposes of limitation.

FIG. 18 is an exemplary line graph of the voltage standing wave ratio (VSWR) versus frequency (GHz) measured for the physical prototype of the antenna assembly 100 including the radome 118. The VSWR may be lower because of a wide dipole shape that may allow approximately constant impedance versus frequency.

FIG. 19 is an exemplary line graph of the peak gain in decibels relative to isotropic (dBi) versus frequency (MHz) measured for the physical prototype of the antenna assembly 100 including the radome 118. The measured radiating gain may average about eight dBi.

FIG. 20 is an exemplary line graph of the ripple in decibels versus frequency (MHz) measured for the physical prototype of the antenna assembly 100 including the radome 118. The radiating ripple may be very low, such as, for example, less than about two decibels.

FIG. 21 shows the pattern orientation and planes relative to a prototype antenna during radiation pattern testing. FIG. 22 illustrates radiation patterns (Theta 90°, Phi 0°, and Phi 90° plane) measured for the physical prototype of the antenna assembly 100 including the radome 118 at a frequency of about 2450 MHz. FIG. 23 illustrates radiation patterns (Theta 90°, Phi 0°, and Phi 90° plane) measured for the physical prototype of the antenna assembly 100 including the radome 118 at a frequency of about 5500 MHz. Generally, FIGS. 22 and 23 show that the example antenna assembly 100 may provide excellent azimuth radiation patterns with very little ripple in the horizon, and may provide clean elevation patterns with a beam steady at the horizon.

Exemplary embodiments of the antenna assemblies are disclosed herein that may provide one or more of the following advantages. Exemplary antenna assemblies may provide a compact form, such as, for example, less than 15 inches (381 millimeters) in length, may include only four dipole-like radiating elements on a first board and on a second board, and may include only four interconnecting boards. Some antenna assemblies may provide a high gain, such as, for example, between about 8 dBi and about 10 dBi, for at least two Wi-Fi frequency bands (e.g., 2.4 GHz Wi-Fi band and 5 GHz Wi-Fi band, etc.). Some antenna assemblies may provide low omnidirectional radiation ripple in the horizon for substantially all desirable operating frequencies. Some antenna assemblies may provide a low VSWR, such as, for example, less than about 1.5:1 for substantially all desirable operating frequencies.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purposes of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an,"

and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An antenna assembly comprising:

a first radiating board including one or more dipole radiating elements;

a second radiating board including one or more dipole radiating elements;

a network board between the first and second radiating boards such that the first and second radiating boards are respectively spaced apart from upper and lower surfaces of the network board, the network board including a feed network and a ground plane; and one or more interconnect boards operable for providing an electrical connection between the feed network and the dipole radiating elements of the first and second radiating boards, the one or more interconnect boards being perpendicular to the network board, the one or more interconnect boards including a first end electrically connected to the first radiating board and a second end electrically connected to the second radiating board;

whereby the dipole radiating elements are operable simultaneously and co-locate radio frequency currents for a first frequency band and a second frequency band.

2. The antenna assembly of claim 1, wherein:

the dipole radiating elements of the first and second radiating boards comprise a first plurality of dipole radiating elements along the first radiating board and a second plurality of dipole radiating elements along the second radiating board; and the one or more interconnect boards comprise a plurality of interconnect boards, each said interconnect board operable for providing an electrical connection between the feed network and a corresponding pair of the dipole radiating elements of the first and second radiating boards.

3. The antenna assembly of claim 2, wherein:

the first plurality of dipole radiating elements is an array of four dipole radiating elements;

the second plurality of dipole radiating elements is an array of four dipole radiating elements; and the plurality of interconnect boards is only four interconnect boards.

4. The antenna assembly of claim 1, wherein:

the one or more dipole radiating elements of the first radiating board comprises four dipole radiating elements along the first radiating board; and the one or more dipole radiating elements of the second radiating board comprises four dipole radiating elements along the second radiating board;

whereby the dipole radiating elements are operable as a four dipole-like 2.4 GHz array co-located with an eight dipole-like 5 GHz array with both arrays using the same radiating elements.

5. The antenna assembly of claim 1, wherein each said dipole radiating element is operable as a single dipole element for the first frequency band and as two dipole elements for the second frequency band.

6. The antenna assembly of claim 1, wherein each said dipole radiating element includes:

a first portion having one or more dipole slots; and a second portion having one or more dipole slots and separated from the first portion by a spaced distance.

7. The antenna assembly of claim 6, wherein each said dipole radiating element is configured such that there are currents that flow in a same direction along each of the first and second portions for the first and second frequency bands and such that there are also slot currents that flow around the one or more dipole slots for the second frequency band.

8. The antenna assembly of claim 6, wherein the feed network is configured to be symmetric with a feed point centered relative to the one or more interconnect boards, whereby the symmetric feed results in same phase currents at each corresponding pair of the dipole radiating elements of the first and second radiating boards.

9. The antenna assembly of claim 1, wherein:

the feed network comprises one or more microstrip lines along a first side of the network board;

the ground plane comprises an electrically-conductive laminate along a second side of the network board;

the antenna assembly includes only four interconnect boards and only four dipole radiating elements along each of the first and second radiating boards; and the network board, the first and second radiating boards, and the interconnect boards are within a radome having a length of fifteen inches or less.

10. The antenna assembly of claim 1, wherein the antenna assembly is operable with a voltage standing wave ratio less than or equal to about 1.5:1, a gain of at least seven decibels relative to isotropic or more, and an omnidirectional radiation ripple in the horizon of less than two decibels for the first frequency band from about 2.4 GHz to about 2.5 GHz and the second frequency band from about 5.15 GHz to about 5.9 GHz.

11. An antenna assembly comprising:

a network board including a feed network and a ground plane;

an array of radiating dipoles including:

a first plurality of radiating dipoles; and a second plurality of radiating dipoles spaced apart from the first plurality of radiating dipoles;

a plurality of interconnect boards perpendicular to the network board, each said interconnect board includes a first end electrically connected to the first plurality of radiating dipoles and a second end electrically connected to the second plurality of radiating dipoles;

wherein the network board is between the first and second pluralities of radiating dipoles such that the first and second pluralities of radiating dipoles are spaced apart from respective upper and lower surfaces of the network board;

whereby the radiating dipoles are operable simultaneously and co-locate radio frequency currents for a first frequency band and a second frequency band.

12. The antenna assembly of claim 11, further comprising:

a first radiating board including the first plurality of radiating dipoles; and a second radiating board including the second plurality of radiating dipoles;

wherein each said interconnect board is operable for providing an electrical connection between the feed network and a corresponding pair of the radiating dipoles of the first and second radiating boards; and wherein:

the first radiating board is parallel to the network board and spaced apart from a first side of the network board; and the second radiating board is parallel to the network board and spaced apart from a second side of the network board.

13. The antenna assembly of claim 12, wherein:

the first plurality of radiating dipoles includes no more than four radiating dipoles;

the second plurality of radiating dipoles includes no more than four radiating dipoles; and the plurality of interconnect boards includes no more than four interconnect boards.

14. The antenna assembly of claim 13, wherein the antenna assembly is operable with a voltage standing wave ratio less than or equal to about 1.5:1, a gain of at least seven decibels relative to isotropic or more, and an omnidirectional radiation ripple in the horizon of less than two decibels for the first frequency band from about 2.4 GHz to about 2.5 GHz and the second frequency band from about 5.15 GHz to about 5.9 GHz.

15. The antenna assembly of claim 14, further comprising a radome having a length of less than about fifteen inches, wherein the network board, the first and second radiating boards, and the plurality of interconnect boards are within an internal space of the radome.

16. The antenna assembly of claim 11, wherein:

the radiating dipoles are operable as a four dipole-like 2.4 GHz array co-located with an eight dipole-like 5 GHz array with both arrays using the same radiating dipoles; and each said radiating dipole is operable as a single dipole element for the first frequency band and as two dipole elements for the second frequency band.

17. The antenna assembly of claim 11, wherein:

each said radiating dipole includes a first portion having one or more dipole slots, and a second portion having one or more dipole slots and separated from the first portion by a spaced distance; and each said radiating dipole is configured such that there are currents that flow in a same direction along each of the first and second portions for the first and second frequency bands and such that there are also slot currents that flow around the one or more dipole slots for the second frequency band.

18. An antenna assembly comprising:

a network board including a feed network and a ground plane;

a first radiating board including a first plurality of radiating dipoles, the first radiating board spaced part from an upper surface of the network board;

a second radiating board including a second plurality of radiating dipoles, the second radiating board spaced apart from a lower surface of the network board;

a plurality of interconnect boards perpendicular to the network board, each said interconnect board operable for providing an electrical connection between the feed network and a corresponding pair of the radiating dipoles of the first and second radiating boards, each said interconnect board including a first end electrically connected to the first radiating board and a second end electrically connected to the second radiating board;

wherein the antenna assembly has no more than four interconnect boards; and wherein the array of radiating dipoles includes no more than four radiating dipoles along each of the opposite sides of the feed network and the ground plane;

whereby the radiating dipoles are operable within a first frequency band from about 2.4 GHz to about 2.5 GHz and within a second frequency band from about 5.15 GHz to about 5.9 GHz.

19. The antenna assembly of claim 18, wherein:

the radiating dipoles are operable simultaneously and co-locate radio frequency currents for the first frequency band and the second frequency band; and/or the radiating dipoles are operable as a four dipole-like 2.4 GHz array co-located with an eight dipole-like 5 GHz array with both arrays using the same radiating dipoles; and/or each said radiating dipole is operable as a single dipole element for the first frequency band and as two dipole elements for the second frequency band.

20. The antenna assembly of claim 18, wherein:

the antenna assembly is operable with a voltage standing wave ratio less than or equal to about 1.5:1, a gain of at least seven decibels relative to isotropic or more, and an omnidirectional radiation ripple in the horizon of less than two decibels for the first frequency band from about 2.4 GHz to about 2.5 GHz and the second frequency band from about 5.15 GHz to about 5.9 GHz;

the antenna assembly further comprises a radome having a length of less than about fifteen inches; and the feed network, the ground plane, the array of radiating dipoles, and the plurality of interconnect boards are within an internal space of the radome.

* * * * *